US007735689B2

(12) United States Patent
Alluigi

(10) Patent No.: US 7,735,689 B2
(45) Date of Patent: Jun. 15, 2010

(54) MANUALLY ACTUATED DISPENSING DEVICE PROVIDED WITH ACTUATION LOCKING MEANS

(75) Inventor: Riccardo Alluigi, Acqui Terme (IT)

(73) Assignee: Guala Dispensing S.p.A., Alessandria (IT)

( * ) Notice: Subject to any disclaimer, the term of this patent is extended or adjusted under 35 U.S.C. 154(b) by 425 days.

(21) Appl. No.: 11/801,690

(22) Filed: May 10, 2007

(65) Prior Publication Data

US 2008/0116222 A1 May 22, 2008

(30) Foreign Application Priority Data

Nov. 16, 2006 (EP) ..... 06425779

(51) Int. Cl.
*B67B 1/00* (2006.01)

(52) U.S. Cl. ..... 222/153.13; 222/321.8; 222/340; 222/384

(58) Field of Classification Search ..... 222/153.13, 222/153.14, 321.8, 340, 372, 384
See application file for complete search history.

(56) References Cited

U.S. PATENT DOCUMENTS 4,889,262 A * 12/1989 Toms ..... 222/153.13
5,297,701 A * 3/1994 Steijns et al. ..... 222/340
5,823,395 A * 10/1998 Foster et al. ..... 222/153.13
6,006,950 A * 12/1999 Watanabe et al. ..... 222/153.13
6,439,481 B2 * 8/2002 von Schuckmann ..... 222/321.8
6,669,058 B1 * 12/2003 Sweeton ..... 222/153.13
2005/0023300 A1 2/2005 Schultz

FOREIGN PATENT DOCUMENTS

| | | | |
|---|---|---|---|
| DE | 10 2005 013 408 | A1 | 9/2006 |
| EP | 0 953 381 | A2 | 11/1999 |
| EP | 1 281 443 | A2 | 2/2003 |
| JP | 10-235240 | | 9/1998 |
| WO | WO 99/33576 | | 7/1999 |
| WO | WO 2006/100028 | A1 | 9/2006 |

OTHER PUBLICATIONS

European Search Report for EP 06 42 5779 dated Mar. 28, 2007.

* cited by examiner

*Primary Examiner*—Kevin P Shaver
*Assistant Examiner*—Jonathan Wood
(74) *Attorney, Agent, or Firm*—Kilyk & Bowersox, P.L.L.C.

(57) ABSTRACT

The present invention is a fluid dispensing device, connectable/disconnectable to/from a container. The device, actuable by a trigger, comprises both closing means comprising a turnable nozzle and means for locking the sliding of a dispensing piston.

19 Claims, 7 Drawing Sheets

MANUALLY ACTUATED DISPENSING DEVICE PROVIDED WITH ACTUATION LOCKING MEANS

BACKGROUND OF THE INVENTION

1. Field of the Invention

The present invention relates to a manually actuated fluid dispensing device provided with actuation locking means.

2. Description of the Prior Art

It has long been known that it is very useful to provide dispensing devices, for example with a trigger, with closing means suitable for closing the dispensing holes provided at the end of the dispensing duct, so that in the closed configuration, the accidental fluid escape is prevented.

Such undesired escape can occur during the transport of the bottles, for example due to an increase in temperature which makes the pressure inside the container increase, or in the household field.

An example of a dispensing device provided with closing means is described in document U.S. Pat. No. 4,706,888.

However, the presence of the closing means does not completely solve the problem of undesired fluid escapes.

During transport, or even in the household field, the bottle trigger may be accidentally pressed, thus causing the leak of fluid from device zones other than the dispensing holes, closed by the above closing means.

SUMMARY OF THE INVENTION

The object of the present invention is to overcome such problem, especially evident when the device actuation takes place through projecting triggers.

Such object is achieved by a dispensing device connectable/disconnectable to/from a container suitable for containing the fluid, wherein the device comprises:

pumping means suitable for being actuated for dispensing the fluid outside the device, wherein the pumping means comprises a) an enclosure delimiting a pumping chamber for containing the amount of fluid to be dispensed;

b) a piston suitable to slide in the enclosure along a dispensing axis for forcing dispensing of the amount of fluid to be dispensed, the device being suitable for dispensing the fluid in the direction of the piston dispensing axis;

c) a dispensing duct operatively connected to the pumping chamber for conducting the amount of fluid to be dispensed outwards;

actuating means suitable for being handled for actuating the pumping means, comprising a trigger comprising an actuating portion for influencing the piston;

manually actuable closing means cooperating with the dispensing duct for closing the duct and preventing the fluid from dispensing, comprising a nozzle;

manually actuable locking means cooperating with the pumping means, suitable for limiting the piston travel in the enclosure for preventing the fluid from dispensing;

wherein the nozzle, by means of its rotation, brings the closing means to the open configuration in which the fluid communication between the dispensing duct and the external environment is restored and brings the locking means in the unlocked configuration in which the pumping means are actuable for dispensing the fluid.

BRIEF DESCRIPTION OF THE DRAWINGS

The features and advantages of the dispensing device according to the present invention will appear more clearly from the following description, made by way of an indicative and non-limiting example with reference to the annexed figures, wherein.

DESCRIPTION OF THE PREFERRED EMBODIMENTS

Figure 1:
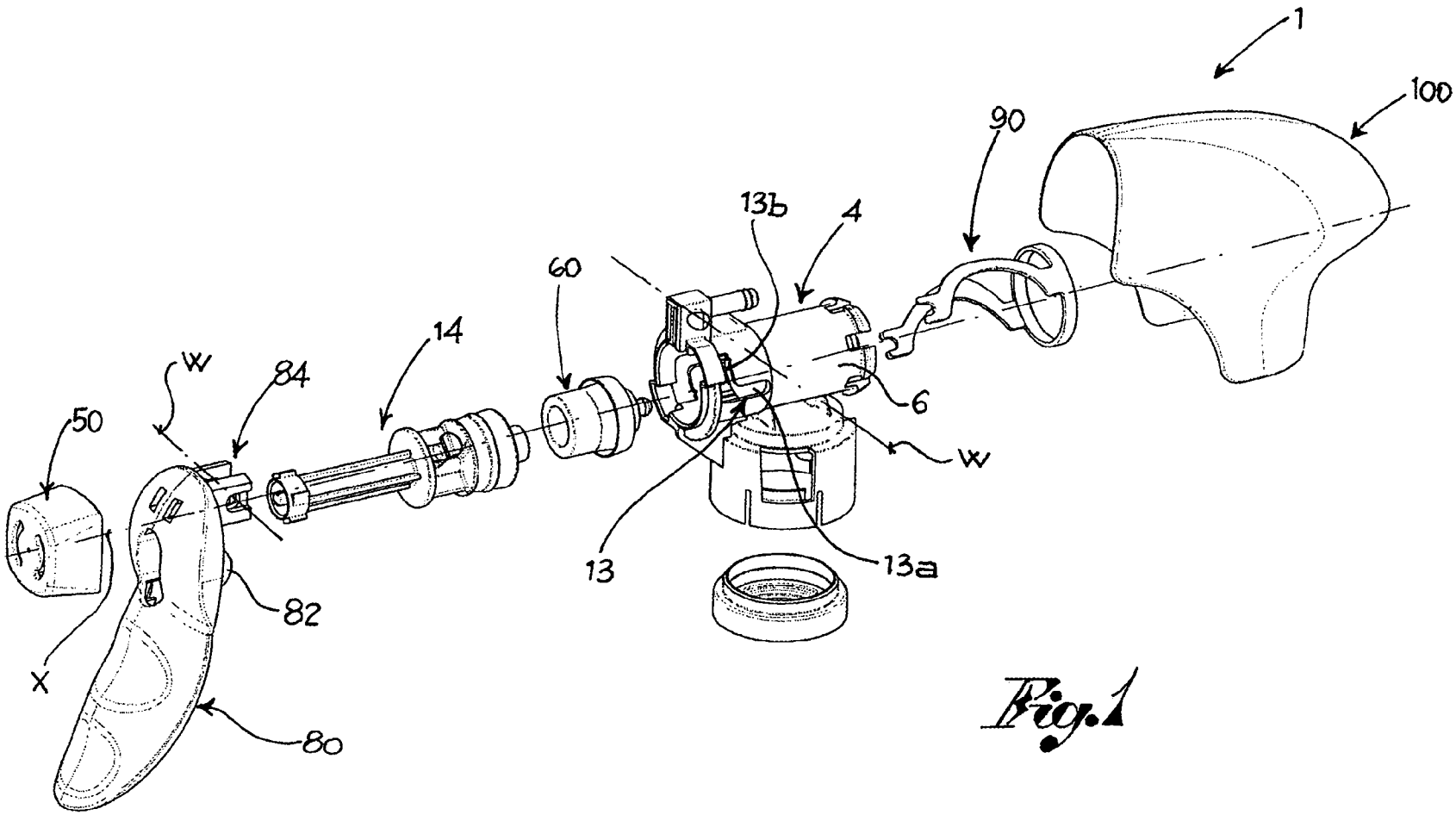
FIG. 1 shows an exploded view of the dispensing device according to the present invention.
Figure 2:
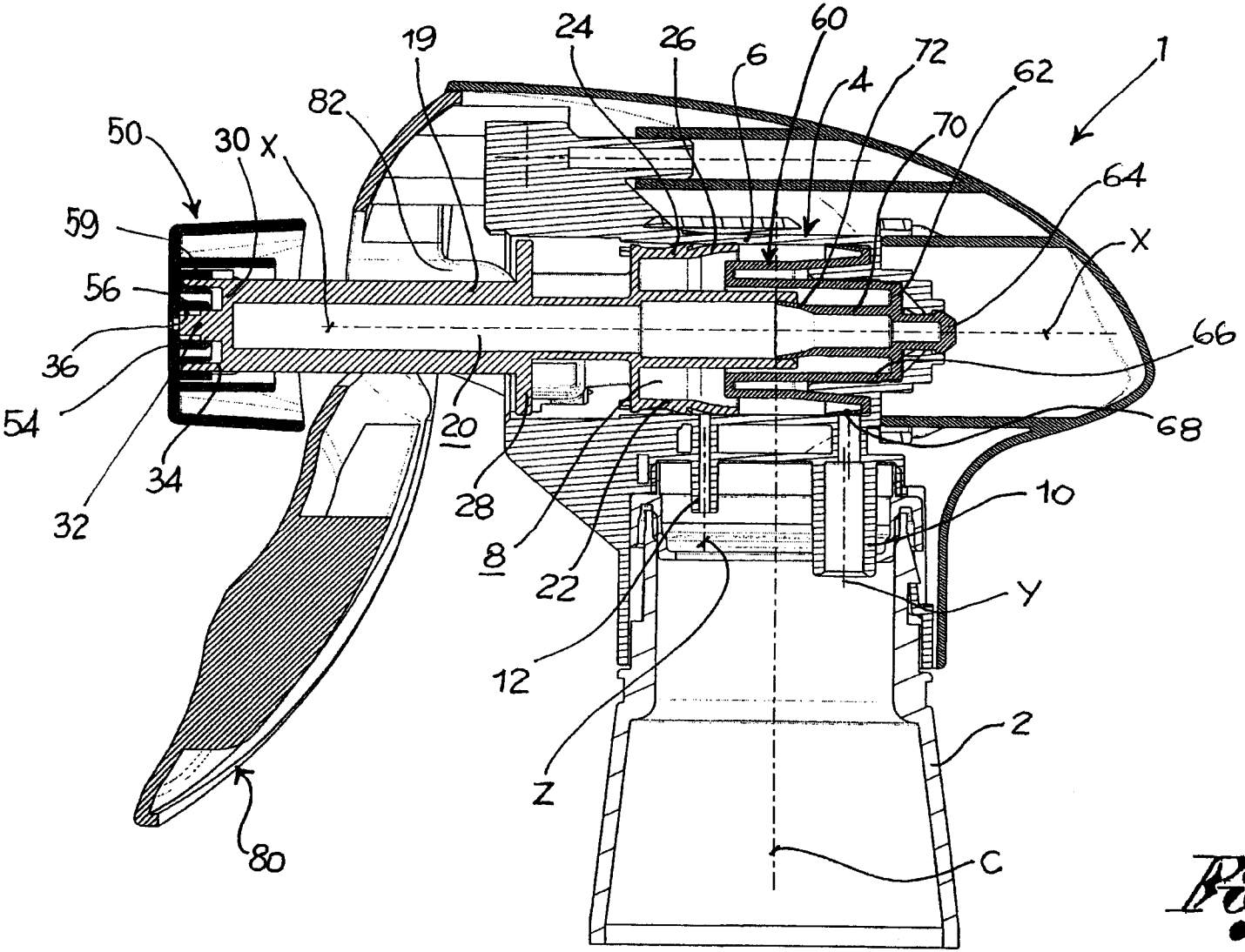
FIG. 2 shows a plan section view of the device of FIG. 1, in an assembled configuration, wherein the device is fitted on the neck of a container.

In accordance with the annexed figures, reference numeral 1 globally indicates a fluid dispensing device, connectable/disconnectable to/from a container having a neck 2.

Device 1 comprises pumping means suitable for being actuated for dispensing the fluid outside the device.

The pumping means comprise an enclosure 4 comprising an annular wall 6 that delimits a pumping chamber 8 therein for containing the amount of fluid to be dispensed. The pumping chamber 8 extends along a dispensing axis X.

Preferably, neck 2 of the container associable to device 1 extends along a container axis C perpendicular to the dispensing axis X.

According to a preferred embodiment, enclosure 4 comprises an intake duct 10 that leads into chamber 8 and is intended for the fluid flow from the container towards the chamber.

For example, the intake duct 10 extends along an intake axis Y perpendicular to the dispensing axis X of chamber 8.

According to a further embodiment, enclosure 4 comprises a venting duct 12 that leads into chamber 8 and is intended for the air flow from the exterior to the container.

For example, the venting duct 12 extends along a venting axis Z perpendicular to the dispensing axis X of chamber 8.

Moreover, the annular wall 6 of enclosure 4 has at least one slot 13, passing through the annular wall 6.

Slot 13 comprises a sliding portion 13*a*, parallel to the dispensing axis X, and a locking portion 13*b*, having an inclined axis relative to the dispensing axis X.

For example, the locking portion 13*b* of slot 13 extends perpendicular to the sliding portion 13*a*, the slot 13 thus taking an "L" shape.

According to a preferred embodiment, enclosure 4 comprises stopping tongues 13*c*, flexible and radially projecting from the annular wall 6, to an end thereof.

Moreover, the pumping means comprise a piston 14 sliding in the enclosure 4 along the dispensing axis X, for forcing dispensing of the amount of fluid to be dispensed.

Piston 14 extends along the dispensing axis X between a proximal end 16 and an opposite distal end 18, facing the fluid dispensing zone.

A tubular wall 19 extends from the proximal end 16 to the distal one 18, inside which there is obtained a dispensing duct 20.

From the proximal end 16 towards the distal end 18, piston 14 preferably comprises a skirt 22, annularly projecting from the tubular wall 19, from which a first annular lip 24 and a second annular lip 26, axially spaced from the first one, externally project radially.

The first annular lip 24 constitutes an example of venting means suitable for allowing the air passage from the exterior towards the venting duct 12 in a compression step during the device operation.

The second annular lip 26 constitutes a partition wall between chamber 8 and the venting duct 12.

After skirt 22, piston 14 comprises at least one projection 27, projecting from the tubular wall 19.

In the embodiment shown, piston 14 comprises a pair of projections 27, arranged along the same direction, perpendicular to the dispensing axis X, that is, radial.

After projections 27, piston 14 comprises an actuating disk 28, projecting from the tubular wall 19, for example radially.

Projections 27 extend radially beyond the radial overall dimensions of disk 28 and skirt 22.

In the proximity of the distal end 18, piston 14 comprises a connecting portion comprising a closing wall 30, closing the dispensing duct 20, a feeding element 32, axially projecting from the closing wall 30 in central position relative thereto, and an outer annular wall 34, axially projecting from the closing wall 30, surrounding the feeding element 32, and radially spaced therefrom.

At the ends thereof, the feeding element 32 has grooves 36, connected to the dispensing duct 20 through holes obtained in the feeding element 32.

The connecting portion further comprises at least one pair of travel end projections 38, externally projecting from the outer annular wall 34 and angularly spaced from one another.

The connecting portion of piston 14 engages with a nozzle 50 that constitutes an example of closing means of device 1, manually actuable, preferably in rotation, and cooperating with the dispensing duct 20 for closing the duct and preventing the fluid dispensing.

In accordance with a preferred embodiment, nozzle 50 comprises an annular handling wall 52, suitable for being grabbed, for example between the fingers of a user, for rotating the nozzle about the dispensing axis X.

The annular handling wall 52 is closed on one side by a dispensing wall 54, provided with at least one dispensing through hole 55.

Internally, nozzle 50 comprises an annular closing wall 56, axially projecting from the dispensing wall 54, and having dispensing grooves 58. The annular closing wall 56 surrounds the dispensing hole 55.

Preferably, moreover, nozzle 50 comprises an annular coupling wall 59, axially projecting from the dispensing wall 54, and radially spaced relative to the annular closing wall 56.

Preferably, moreover, nozzle 50 comprises at least one engagement tooth 59*a*, for example internally projecting axially from the dispensing wall 54, and suitable for engaging the travel end projections 38 of piston 14.

In accordance with a preferred embodiment, moreover, device 1 comprises an engagement element 60 with which piston 14 is slidingly engaged.

The engagement element 60 is inserted into enclosure 4, for example with a shape coupling.

According to a preferred embodiment, the engagement element 60 comprises a bottom wall 62 and a mushroom projection 64, axially projecting from the bottom wall 62 for engaging with enclosure 4.

Preferably, moreover, the engagement element 60 comprises an outer tubular wall 66, axially projecting from the bottom wall 62 on the opposite side relative to the mushroom projection 64 and preferably axially folded on itself, for obtaining a further coupling with the enclosure.

Preferably, moreover, the engagement element 60 comprises a flexible annular lip 68, projecting from the outer tubular wall 66, for example at the free end of the folded portion thereof.

In particular, once the engagement element 60 is positioned into enclosure 4, the annular lip 68 moves in abutment with the annular wall 6 of enclosure 4 so as to separate the intake duct 10 from chamber 8.

It should be noted that the flexible lip 68 constitutes an example of valve intake means suitable for allowing the fluid flow from the container to chamber 8 during the intake step of the device operation and suitable for preventing the fluid flow from chamber 8 to the intake duct 10 in a dispensing step of the device operation.

Preferably, moreover, the engagement element 60 comprises an inner tubular wall 70, axially projecting from the bottom wall 62, radially internally relative to the outer tubular wall 66.

The inner tubular wall 70 comprises a flexible end portion 72, opposite the end connected to the bottom wall 62, shaped as a truncated cone, suitable for engaging with the tubular wall 19 of piston 14, therein.

It should be noted that the end portion 72 constitutes an example of valve delivery means suitable for allowing the fluid flow from chamber 8 to the dispensing duct 20 in a dispensing step of the device operation and suitable for preventing the fluid flow from the dispensing duct 20 to chamber 8 in a fluid intake step.

Moreover, device 1 comprises actuating means suitable for being handled for actuating the pumping means.

The actuating means comprise a trigger 80 comprising an actuating portion 82 for influencing the piston 14. For example, the actuating portion 82 is suitable for influencing the actuating disk 28 of piston 14.

Preferably, moreover, the actuating portion 82 is shaped as a cam for regulating the action of trigger 80 on piston 14 according to the needs.

Preferably, moreover, trigger 80 comprises a hinging portion 84 hinged to enclosure 4 for allowing the rotation of trigger 80 in actuation about a hinging axis W, perpendicular to the dispensing axis X.

Device 1 further comprises elastic return means suitable for influencing the pumping means from the dispensing configuration, wherein the pumping chamber 8 has a reduced volume, to the rest configuration, wherein the pumping chamber 8 has a larger volume than the reduced volume.

Preferably, the elastic return means are arranged external to chamber 8 and, for example, they are engaged with projections 27 of piston 14.

According to a preferred embodiment, the elastic return means comprise an elastic element 90 turnable about the dispensing axis X for following the rotation of piston 14.

Preferably, the elastic element 90 comprises a mounting ring 92 and at least one flexible branch 94 projecting along the axial direction from ring 92.

Ring 92 is fitted on enclosure 4 in a turnable manner and branch 94 is engaged with piston 14.

Preferably, ring 92 is unilaterally axially constrained by tongues 13*c* projecting from wall 6 of enclosure 4.

As can be understood, the tongues 13*c* constitute an example of constraining means for the elastic means, the constraining means being suitable for obtaining a unilateral axial constraint of the elastic element 90 to enclosure 4.

Preferably, branch 94 has an arched portion 96, ending with a tine portion 98 for the engagement with projections 27 of piston 14.

Preferably, in the rest configuration of the pumping means, branch 94 extends along the outer surface of enclosure 4, in contact therewith.

In other words, in the rest configuration, branch 94 has a shape not containable in a plane, as it extends along a hypothetical line traced on a cylindrical surface. The arched portion 96 further forms a loop which advantageously allows settling branch 94 in the dispensing configuration wherein it is deformed.

Preferably, the elastic element 90 is made in a single piece, for example of acetal resin.

Preferably, moreover, device 1 comprises covering means suitable for making a cover for the pumping means.

For example, the covering means comprise a cover 100, axially projecting from the side opposite the dispensing zone and rounded, so as to obtain an ergonomic stop for the user's hand.

In order to illustrate the standard operation of device 1, at first we shall suppose that this is in a rest configuration, wherein trigger 80 is not handled by the user, in a closed configuration of the closing means and in a locked configuration of the locking means.

In such situation, the elastic means influence the piston removing it, as much as possible, from enclosure 4, so that the pumping chamber 8 has the maximum volume.

Figure 3B:
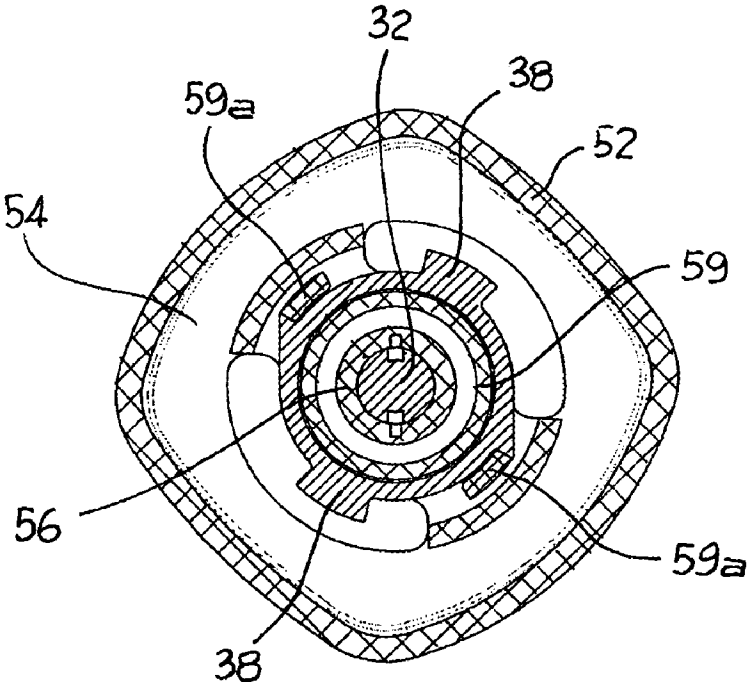
FIGS. 3*a* and 3*b* show an operating diagram of the closing means of the device, in a closed configuration and in an open configuration, respectively.
Figure 3A:
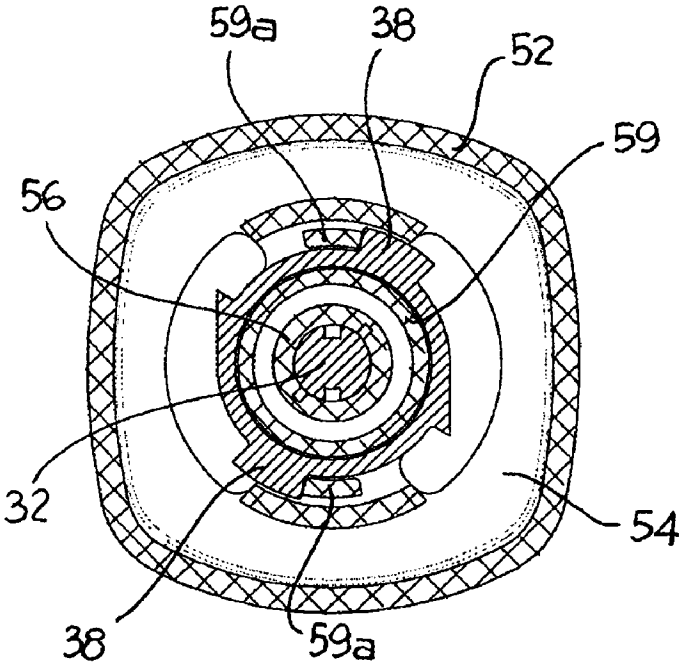
Figure 4B:
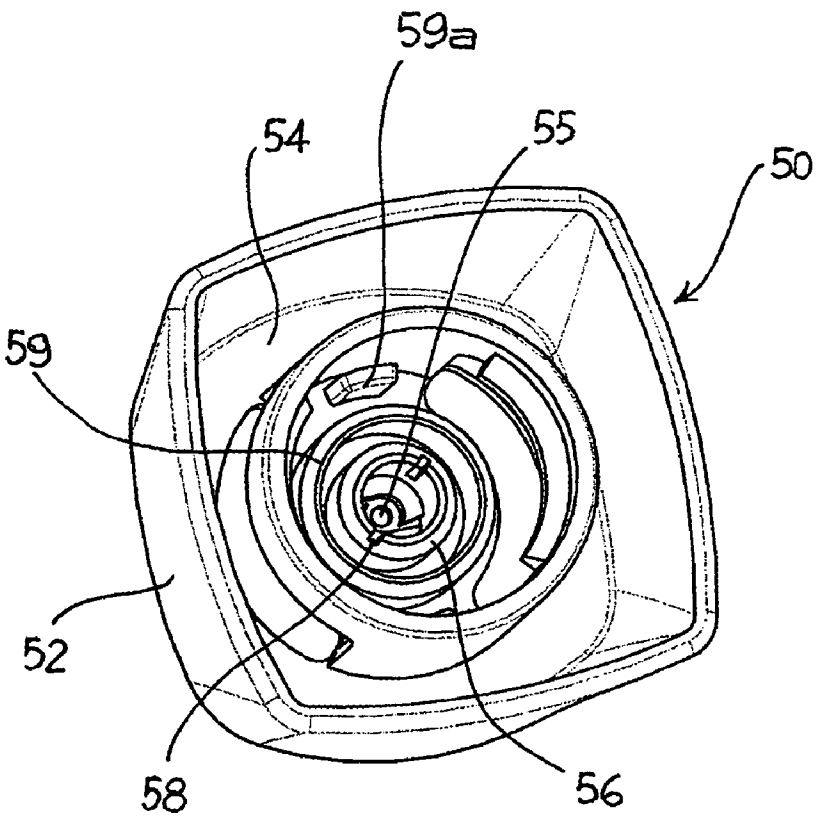
FIGS. 4*a* and 4*b* show perspective views of a nozzle of the device closing means.
Figure 4A:
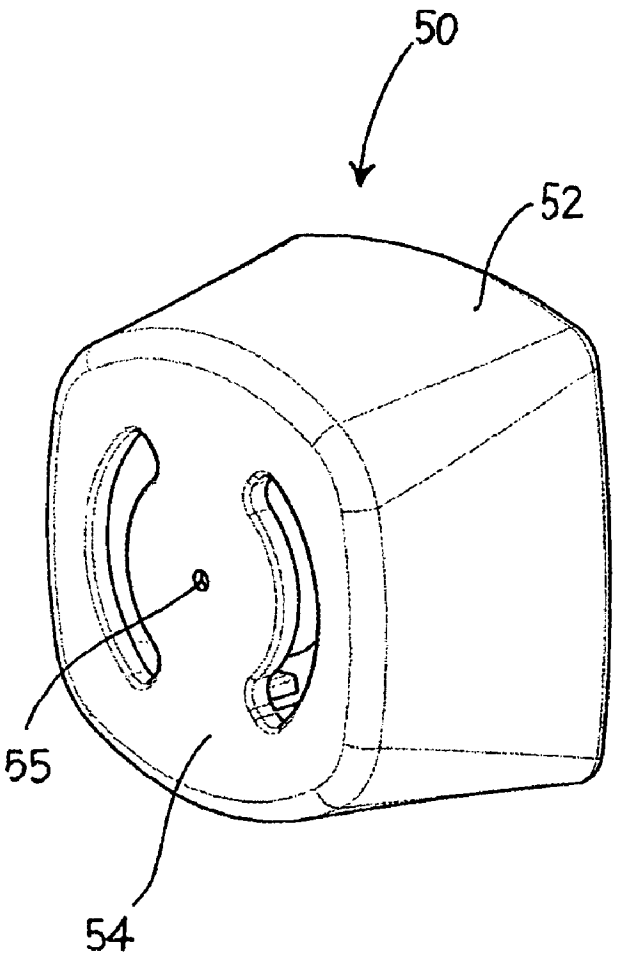

Moreover, nozzle 50 is in a first position wherein the closing wall 56 closes grooves 36 of the feeding element 32 of the connecting portion of piston 14 (FIG. 3*a*).

In this way, the fluid communication between the dispensing duct 20 and the external environment is interrupted.

Figure 5B:
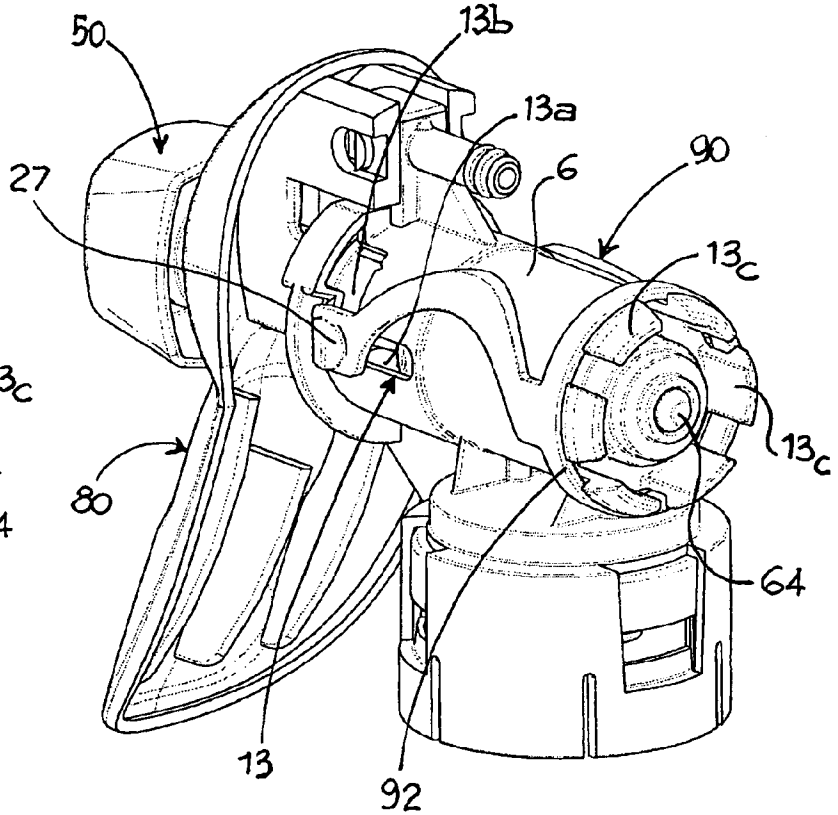
FIGS. 5*a* and 5*b* show an operating diagram of the locking means of the device, in a locked configuration and in an unlocked configuration, respectively.
Figure 5A:
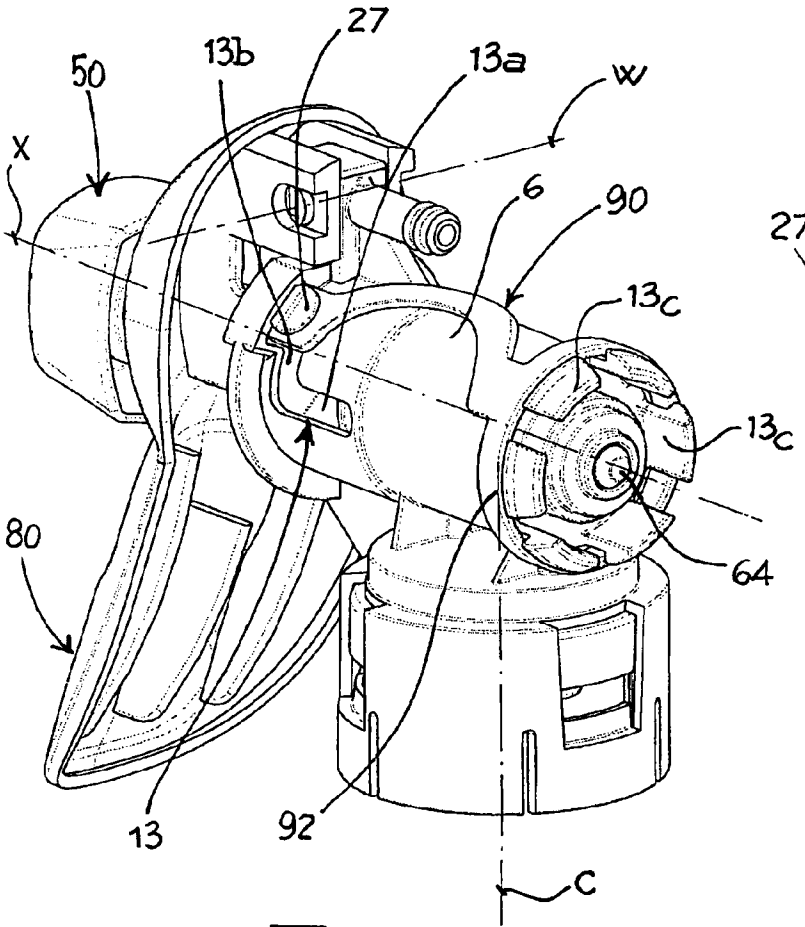
Figure 6A:
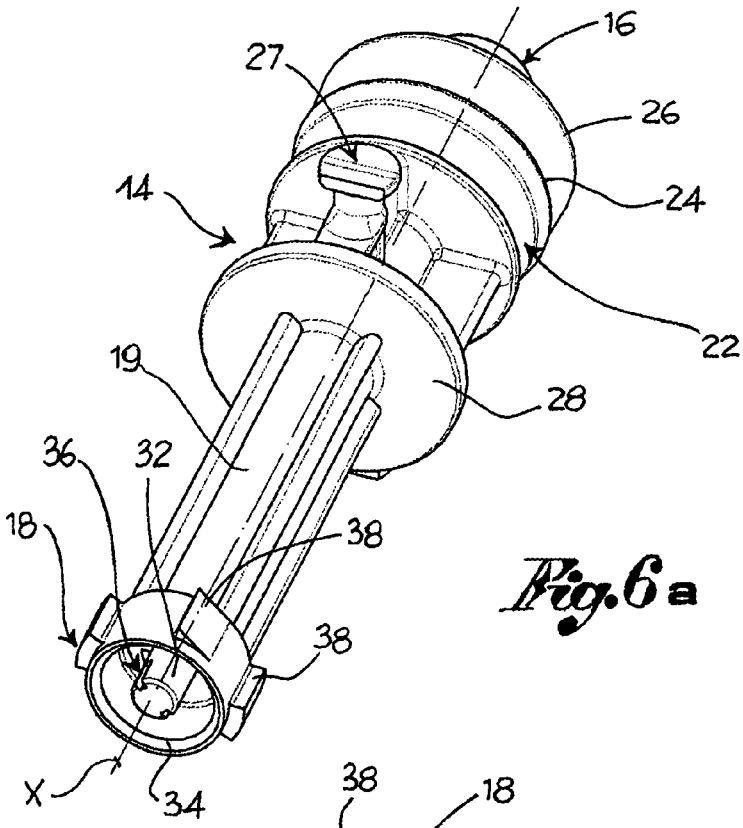
FIGS. 6*a* and 6*b* show a piston of pumping means of the device.
Figure 6B:
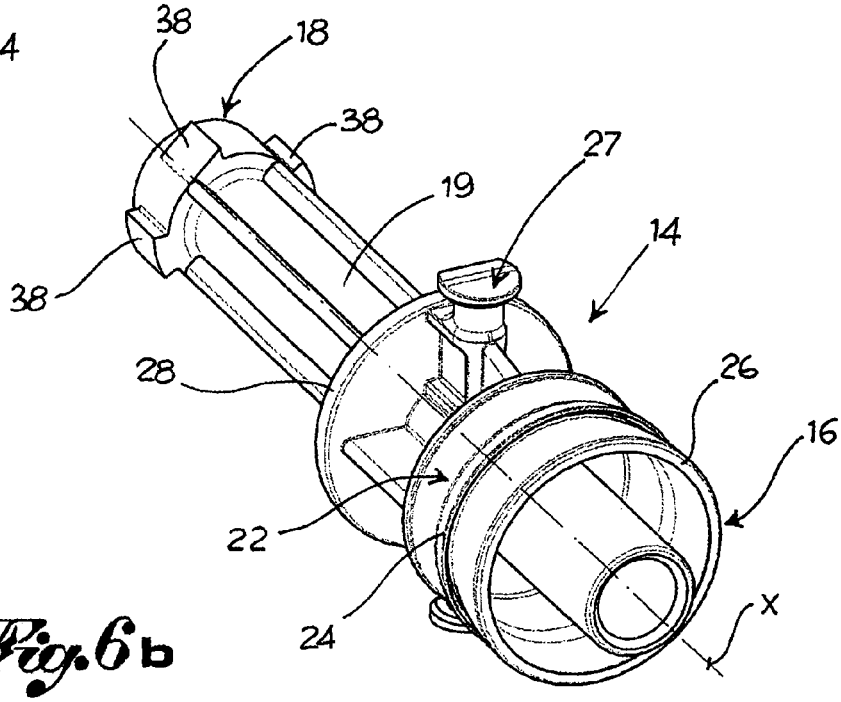
Figure 7B:
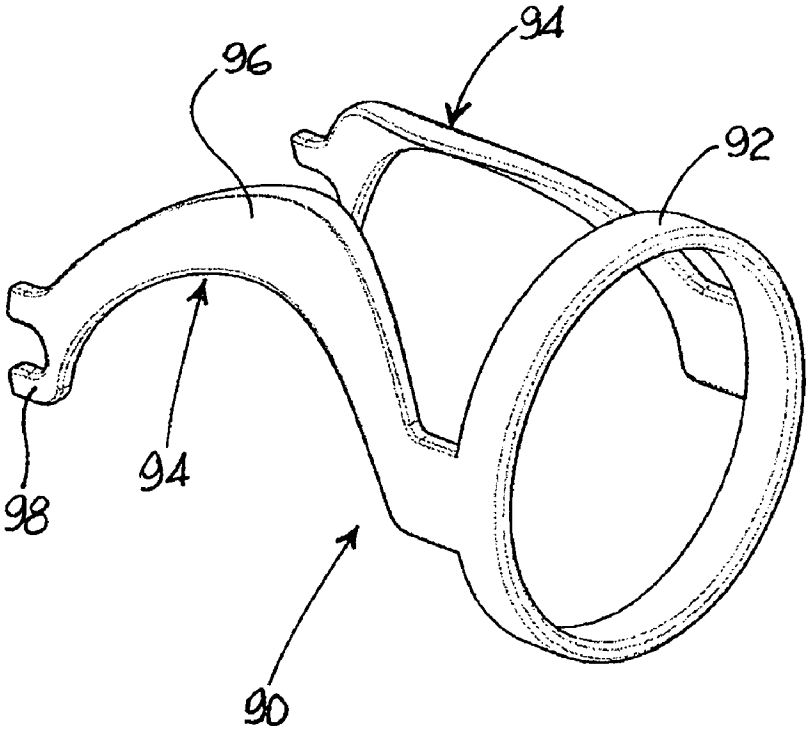
FIGS. 7*a* and 7*b* show an elastic element of return means of the device.
Figure 7A:
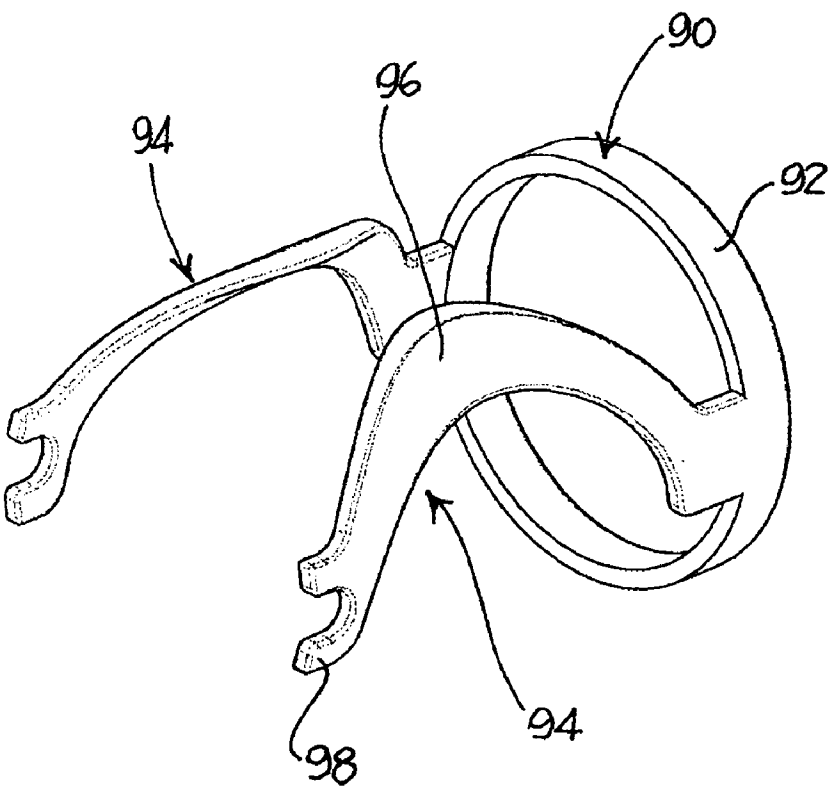

Moreover, piston 14 is in a first position wherein projections 27 are seated in the locking portion 13*b* of slot 13, which mainly extends along a direction incident to the dispensing axis X (FIG. 5*a*).

The sliding of piston 14 along the dispensing axis X is therefore prevented or strongly limited, so even when acting on trigger 80, such action does not bring about fluid dispensing.

For the dispensing of fluid, the closing means are brought to the open configuration and the locking means are brought to the unlocked configuration.

In particular, nozzle 50 is grabbed, for example between the user's fingers, and rotated about the dispensing axis X.

In the open configuration, the nozzles takes a rotated position relative to the previous position, wherein the dispensing grooves 58 obtained in the closing wall 56 of nozzle 50 are at least partly overlapped to grooves 36 of the feeding element 32.

In such position, the fluid communication between the dispensing duct 20 and the external environment is restored.

By virtue of a further rotation of nozzle 50, in the same direction of rotation, the engagement tooth 59*a* of nozzle 50 moves in abutment with the travel end projections 38, whereas the fluid communication between grooves 36 and the dispensing grooves 58 is maintained (FIG. 3*b*).

By virtue of the engagement between tooth 59*a* and the travel end projection 38, rotating nozzle 50 in the same direction of rotation, a rotation of piston 14 about the dispensing axis X is also obtained.

The piston rotation makes projections 27 exit from the locking portion 13*b* of slot 13, moving into the sliding portion 13*a* thereof (FIG. 5*b*).

In this condition, the sliding of piston 14 is allowed, therefore it is possible to actuate the dispensing means and dispense the fluid through a repeated actuation of trigger 80.

As can be understood, device 1, also associated to the container, is suitable for being grabbed for aiming the jet of fluid being dispensed towards a surface to be sprinkled, preferably in the direction of the dispensing axis X of piston 14.

During the piston rotation between the locked configuration and the unlocked configuration, the elastic element 90, integral in rotation to piston 14, rotates therewith, preventing harmful distortions of the structure.

In the unlocked configuration of the locking means, device 1 is suitable for switching from a rest configuration to a dispensing configuration and vice versa, for carrying out the fluid dispensing.

In the dispensing configuration, the pumping chamber 8 has a reduced volume. The volume reduction of chamber 8 causes the flow of the amount of fluid to be dispensed from the pumping chamber 8 to the dispensing duct 20.

In the rest configuration, the pumping chamber 8 has a larger volume than the reduced volume. The volume increase of chamber 8 from the reduced volume to the larger volume causes the flow of the amount of fluid to be dispensed from the container to the pumping chamber 8.

The operating step of device 1 from the rest configuration to the dispensing configuration is called the dispensing step, which takes place with fluid compression, whereas the step from the dispensing configuration to the rest configuration is called the intake step.

Innovatively, the device according to the present invention allows obviating the leaking problems currently found in the field.

According to a further embodiment variation of the invention, the device is preferably without closing means and comprises:

pumping means suitable for being actuated for dispensing the fluid outside the device, wherein the pumping means comprise a) an enclosure delimiting a pumping chamber for containing the amount of fluid to be dispensed;

b) a piston sliding in the enclosure along a dispensing axis for forcing dispensing of the amount of fluid to be dispensed;

c) a dispensing duct operatively connected to the pumping chamber for conducting the amount of fluid to be dispensed outwards;

actuating means suitable for being handled for actuating the pumping means;

manually actuable locking means cooperating with the pumping means, suitable for limiting the piston travel in the enclosure for preventing the fluid dispensing, and wherein the locking means comprise a) at least one projection projecting from the piston;

b) at least one slot obtained in the enclosure, wherein the slot comprises a sliding portion, parallel to the dispensing axis, and a locking portion, having an inclined axis relative to the dispensing axis;

and wherein the piston is turnable in the enclosure about the dispensing axis for allowing the introduction of the projection in the locking portion of the slot and limiting the piston travel.

According to a further embodiment variation of the invention, the device is preferably without closing means and comprises:

pumping means suitable for being actuated for dispensing the fluid outside the device, wherein the pumping means comprise a) an enclosure therein delimiting a pumping chamber for containing the amount of fluid to be dispensed;

b) a piston suitable for sliding in the enclosure along a dispensing axis for forcing dispensing of the amount of fluid to be dispensed, the piston being turnable about the dispensing axis for moving from a locked configuration, wherein the piston travel along the dispensing axis is prevented, to an unlocked configuration;

actuating means suitable for being handled for actuating the pumping means;

elastic return means suitable for influencing the pumping means from a dispensing configuration, wherein the pumping chamber has a reduced volume, to the rest configuration, wherein the pumping chamber has a larger volume than the reduced volume, wherein the elastic return means comprise a) an elastic element, engaged with the piston, turnably mounted about the dispensing axis for following the rotation of the piston between the locked configuration and the unlocked configuration thereof.

According to an even further embodiment variation, the dispensing device is preferably without closing and locking means and the elastic element is not rotating, and comprises:

pumping means suitable for being actuated for dispensing the fluid outside the device, wherein the pumping means comprise a) an enclosure therein delimiting a pumping chamber for containing the amount of fluid to be dispensed, the enclosure comprising an annular wall having an outer surface;

b) a piston suitable for sliding in the enclosure along a dispensing axis for forcing dispensing of the amount of fluid to be dispensed;

actuating means suitable for being handled for actuating the pumping means;

elastic return means suitable for influencing the pumping means from a dispensing configuration, wherein the pumping chamber has a reduced volume, to the rest configuration, wherein the pumping chamber has a larger volume than the reduced volume, wherein the elastic return means comprise a) an elastic element, engaged with the piston, comprising at least one flexible branch which in the rest configuration of the pumping means, extends along the outer surface of the enclosure, in contact therewith.

What is claimed is:

1. A fluid dispensing device connectable/disconnectable to/from a container suitable for containing a fluid, wherein the device comprises:

pumping means suitable for being actuated for dispensing the fluid outside the device, wherein the pumping means comprises a) an enclosure delimiting a pumping chamber for containing the amount of fluid to be dispensed;

b) a piston suitable to slide in the enclosure along a dispensing axis for forcing dispensing of the amount of fluid to be dispensed, the device being suitable for dispensing the fluid in the direction of the piston dispensing axis;

c) a dispensing duct operatively connected to the pumping chamber for conducting an amount of fluid to be dispensed outwards;

actuating means suitable for being handled for actuating the pumping means, comprising a trigger comprising an actuating portion for influencing the piston;

manually actuable closing means cooperating with the dispensing duct for closing the duct and preventing the fluid from dispensing, comprising a nozzle;

manually actuable locking means cooperating with the pumping means, suitable for limiting the piston travel in the enclosure for preventing the fluid from dispensing;

wherein the nozzle, by means of its rotation, brings the closing means to an open configuration in which the fluid communication between the dispensing duct and the external environment is restored and brings the locking means in an unlocked configuration in which the pumping means are actuable for dispensing the fluid, and in that the piston engages with the nozzle in rotation, and wherein the locking means comprises at least one projection projecting from the piston;

at least one slot located in the enclosure, wherein the slot comprises a sliding portion, parallel to the dispensing axis, and a locking portion, having an inclined axis relative to the dispensing axis;

and wherein the piston is turnable in the enclosure about the dispensing axis for allowing the introduction of the projection in the locking portion of the slot and limiting the piston travel.

2. A device according to claim 1, wherein the dispensing duct is located inside the piston along the dispensing axis.

3. A device according to claim 2, wherein the nozzle is applied to the piston at a distal end of the piston to which the dispensing duct leads, the nozzle comprising a closing wall which, in a closed configuration, closes the dispensing duct.

4. A device according to claim 1, wherein the nozzle comprises at least one engagement tooth for engaging the piston in rotation.

5. A device according to claim 1, wherein the slot locking portion extends perpendicular to the sliding portion, the slot taking an "L" shape.

6. A device according to claim 1, wherein there are two projections, each projecting from the piston along a single direction perpendicular to the piston.

7. A device according to claim 1, comprising elastic return means suitable for influencing the pumping means from a dispensing configuration, wherein the pumping chamber has a reduced volume, to a rest configuration, wherein the pumping chamber has a larger volume than the reduced volume.

8. A device according to claim 7, wherein the elastic return means is arranged externally to the pumping chamber.

9. A device according to claim 1, wherein the elastic return means is arranged externally to the pumping chamber and wherein an elastic return means is engaged with the piston projections.

10. A device according to claim 9, wherein the elastic return means comprises an elastic element suitable to turn about the dispensing axis for following the rotation of the piston.

11. A device according to claim 10, wherein the elastic element comprises a mounting element and at least one flexible branch projecting from a ring, the mounting ring being fitted on the enclosure in a turnable manner and the branch being engaged with the piston.

12. A device according to claim 11, wherein the elastic element is made in a single piece.

13. A device according to claim 12, wherein the elastic element is made of acetal resin.

14. A device according to claim 11, wherein the branch has an arched portion.

15. A device according to claim 1, wherein the actuating portion has a cam shape.

16. A device according to claim 1, wherein the trigger comprises a hinging portion hinged to the enclosure.

17. A device according to claim 1, wherein the trigger is hinged for rotating about a hinging axis (W) for actuating the piston, the hinging axis being perpendicular to the dispensing axis.

18. A device according to claim 1, wherein the device is suitable for being grabbed for aiming the jet of fluid being dispensed towards a surface to be sprinkled.

19. A device according to claim 1, wherein the piston comprises a connecting portion that engages with the nozzle in rotation.

* * * * *